US007399143B2

(12) United States Patent
van Zandwijk et al.

(10) Patent No.: US 7,399,143 B2
(45) Date of Patent: Jul. 15, 2008

(54) METHOD FOR MAKING A CHANNEL IN THE GROUND, EXCAVATING DEVICE FOR MAKING A CHANNEL IN THE GROUND, ASSEMBLY COMPRISING AN EXCAVATING DEVICE AND A CONSTRUCTION ELEMENT

(75) Inventors: Cornelis van Zandwijk, Waddinxveen (NL); Frits-Jan Koppert, Nieuwerkerk a/d IJssel (NL)

(73) Assignee: Heerema Marine Contractors Nederland B.V. (NL)

( * ) Notice: Subject to any disclaimer, the term of this patent is extended or adjusted under 35 U.S.C. 154(b) by 307 days.

(21) Appl. No.: 11/131,320

(22) Filed: May 18, 2005

(65) Prior Publication Data

US 2006/0086011 A1 Apr. 27, 2006

(30) Foreign Application Priority Data

May 19, 2004 (NL) ..... 1026229

(51) Int. Cl.
*E02D 27/12* (2006.01)

(52) U.S. Cl. ..... 405/248

(58) Field of Classification Search ..... 405/248
See application file for complete search history.

(56) References Cited

U.S. PATENT DOCUMENTS 1,853,379 A * 4/1932 Rotinoff ..... 405/8
1,905,643 A * 4/1933 Johnson ..... 405/13
2,678,540 A * 5/1954 Lorenz ..... 405/249
2,931,187 A * 4/1960 Perkins ..... 405/13

FOREIGN PATENT DOCUMENTS

| | | |
|---|---|---|
| DE | 40 25 178 | 2/1992 |
| DE | 203 10 992 | 11/2003 |
| FR | 761 399 | 3/1934 |
| GB | 628 123 | 8/1949 |
| JP | 56 016733 | 2/1981 |
| JP | 60 184127 | 9/1985 |
| JP | 04 034116 | 2/1992 |
| NL | 1 009 671 | 1/1999 |

* cited by examiner

*Primary Examiner*—John Kreck
(74) *Attorney, Agent, or Firm*—Browdy and Neimark

(57) ABSTRACT

With a method and device for producing a channel in the ground, in a first step, an excavating device is positioned at the starting point of a channel to be produced. The excavating device has an excavating head which is provided with one or more liquid jetting devices. Then, a mixture of soil and water is formed by spraying liquid from the liquid jetting devices. This mixture is discharged. The excavating head advances in the excavating direction while the liquid is being sprayed. Thus, the channel is produced. When the end point of the excavation has been reached, at least a part of the excavating device is uncoupled and moved back to the starting point of the channel, so it can be used again.

50 Claims, 12 Drawing Sheets

METHOD FOR MAKING A CHANNEL IN THE GROUND, EXCAVATING DEVICE FOR MAKING A CHANNEL IN THE GROUND, ASSEMBLY COMPRISING AN EXCAVATING DEVICE AND A CONSTRUCTION ELEMENT

The present invention relates to a method for making a channel in the ground in an excavating direction, the channel extending between a starting point and an end point, and the method comprising the following steps: positioning the excavating device comprising an excavating head at the starting point; advancing the excavating head in the excavating direction, soil being loosened from the excavating head in the excavating direction with the aid of a jet of liquid for forming a mixture of soil and liquid, wherein the mixture is discharged from the excavating head to the starting point of the channel.

The invention also relates to an excavating device for producing a channel in the ground. The invention also relates to an assembly comprising an excavating device and a construction element. Methods for producing a channel of this type are known.

EP-B-1 109 988 discloses a method and a device for producing a channel in the ground with the aid of an excavating device. In this case, the excavating device comprises a liquid jetting device which, during use, sprays a powerful jet of liquid, usually water, into the soil. In this case, a mixture of soil and water is formed, which is then discharged. The excavating head advances while the liquid is being sprayed. This method and device is suitable for excavating channels having a starting point and an end point, the excavating device moving below a soil surface at the starting point and emerging from below the soil surface at the end point, or at least coming out of the ground, for example in a construction pit.

However, the method and device known from EP-B-1 109 988 have the drawback that when the method and device are used to produce a blind channel, the excavating device cannot be retrieved when it has reached the end point. After all, if the end point of the channel is in the ground and not on the surface, the excavating device will also be in the ground when it has reached the end point. The excavating device is thus suitable for producing only one blind channel and is subsequently lost. This is an important drawback, as the excavating device is a valuable device.

It is an object of the invention to improve this situation in order to make it technically and economically attractive to use an excavating device with a liquid jetting device for producing a blind channel in the ground.

To this end, the invention firstly provides a method for producing a blind channel in the ground in an excavating direction, the channel to be produced extending between a starting point and an end point, the method comprising the following steps: (a) positioning an excavating device comprising an excavating head at the starting point; (b) advancing the excavating head in the excavating direction, soil being loosened from the excavating head in the excavating direction with the aid of a jet of liquid for forming a mixture of soil and liquid, wherein the mixture is discharged from the excavating head to the starting point of the channel; and (c) moving a return part of the excavating device to the starting point of the channel after the end point of the channel to be produced has been reached.

The channel may in this case be a pit in which a construction has to be built. However, it may also be a channel for producing a bored pile wall or another type of excavation.

The starting point of the channel will usually be on the surface, at ground level. It is also possible for the starting point to be located in a construction pit. The point of departure is that the starting point is accessible in order to position the excavating device. The end point of the channel will usually be under the ground.

In another embodiment, the excavating direction has a downward component, and the excavating direction is preferably substantially downwards. As the whole or part of the excavating device is retrieved, the method is eminently suitable for producing channels which run downwards from the surface.

The excavating head is the part of the excavating device which, viewed in the excavating direction, is situated at the front of the excavating device. A powerful jet of liquid is sprayed from the excavating head. This may be water, but also another liquid. The liquid jet may be directed in one or more directions. For example, it is possible to spray in the excavating direction, but it is also possible to spray in a direction which is substantially at right angles to the excavating direction. The liquid is supplied from the starting point of the channel to the excavating head using a liquid supply line.

The mixture of liquid and soil is discharged by means of a mixture discharge line. This mixture discharge line extends from the excavating head to the starting point of the channel.

If the length of the channel increases while it is being excavated, it may be necessary for the length of the liquid supply line and the mixture discharge line to increase. This may be achieved in practice, for example, by extending the liquid supply line and the mixture discharge line in each case with an extension part. Other ways of extending are likewise possible.

However, it is also possible for the liquid supply line and the mixture discharge line to be of fixed length, the length being sufficiently large to bridge the length between the starting point of the channel and the excavating head when the end point has been reached.

When the end point of the channel is reached, the excavating head is underground. With the method according to the invention, a return part of the excavating device is subsequently moved to the starting point of the channel. In this way, this return part is retrieved for renewed use. The return part may in this case comprise the entire excavating head.

In a further embodiment, the excavating device comprises a return part and an expendable part, the return part and the expendable part being uncoupled in step (c) before the return part is moved to the starting point of the channel.

Advantageously, in this embodiment of the invention, only a portion of the excavating device is moved to the starting point. This may be a valuable portion or a portion of which the manufacture is complicated from a technical point of view. The expendable part which remains behind in the soil may be a less valuable part of the excavating device.

In yet another embodiment, a supporting device is arranged behind the excavating head, viewed in the excavating direction, in step (b) in order to support the soil adjacent to the channel. During the production of the channel, the excavating head moves in the excavating direction. The channel which is produced is bounded by the adjoining soil. It is possible that this soil is not solid and more or less loose. In such a situation, there is a risk that the channel collapses or is damaged. This embodiment has the advantage that the wall of the channel is supported and that a possible collapse is prevented.

In another embodiment, in step (b), the supporting device is moved in the excavating direction. During the advancement of the excavating head, the supporting device thus moves along with the excavating head. In this embodiment, the channel wall is supported in a technically simple and inexpensive manner.

In yet another embodiment, in step (b), the supporting device fitted has a smaller cross-section than the channel produced. A clearance will form between the channel wall and the supporting device, so that the supporting device can be advanced relatively easily. This embodiment has the advantage that the channel wall will only exert a small amount of friction force on the supporting device. Preferably, a filling liquid is introduced in step (b) in a clearance between the supporting device and the soil adjoining the channel. This filling liquid can offer at least two advantages: firstly, the liquid can act as a lubricant between the supporting device and the channel wall in order to further reduce the frictional resistance which is generated between them. Secondly, the liquid can support the channel wall. To this end, it is advantageous if the liquid has a specific gravity which is substantially greater than the specific gravity of water. In this manner, a pressure is created in the clearance from the ground level downwards, which is substantially greater than the water pressure in the earth and the pressure in the clearance will be sufficiently great to counteract the soil pressure, so that the soil adjoining the channel is supported well.

In a further embodiment, the filling liquid is bentonite. The specific gravity of bentonite is substantially greater than the specific gravity of water and is therefore suitable to act as supporting liquid.

In another embodiment, a moving device is provided near the starting point, the return part being moved to the starting point of the channel by the moving device after the end point of the channel has been reached. This is a simple manner in which to retrieve the return part.

Preferably, the moving device comprises a hoisting device and the excavating head is suspended in step (a) from the hoisting device, the hoisting device lowering the excavating head in step (b), and the hoisting device hoisting the excavating head up in step (c). This is a simple and technically reliable manner for both advancing the excavating head in the excavating direction in step (b) and moving part of the excavating device to the starting point in step (c). The hoisting device is arranged near the starting point of the channel. This will usually be a position above ground level. However, it is also possible to position the hoisting device in, for example, a construction pit.

Preferably, in step (b), a supporting device is arranged behind the excavating head, viewed in the excavating direction, in order to support the soil adjacent to the channel, the moving device engaging with the supporting device. In this way, an upwardly directed as well as a downwardly directed force can be exerted on the excavating device in a simple manner.

In an alternative embodiment, the hoisting device is only coupled to the excavating head or a part thereof in step (c). In this embodiment, the excavating head can, for example by the force of its own weight, produce a channel in the ground. When the excavating head has reached the end point of the channel in the ground, the hoisting device will lower a hoisting means, such as a cable or a chain. This may then, for example automatically, be coupled to the excavating head or a part thereof. To this end, a coupling is provided which creates an automatic connection when it contacts the excavating head.

If the supporting device is a supporting device which can be subjected to tensile forces, the supporting device may be used as a hoisting device, instead of a cable or chain. To this end, the hoisting device is coupled to the top of the supporting device. The entire excavating device, including the supporting device, is hoisted up in step (c), back to the starting point of the channel. In this manner, the entire excavating device is retrieved for renewed use. However, it is likewise possible to leave the supporting device itself behind in the channel and to only retrieve the excavating head and/or a part thereof.

The moving device can also be a driven gear wheel construction which is located at ground level. In this case, the supporting device is provided with a toothed element, which extends in the direction of the channel to be produced. The gear wheel construction engages with the toothed element and can thus advance the supporting device and the excavating head in the excavating direction. In addition, the gear wheel construction can advance the supporting device and the excavating head back to the starting point of the channel.

In a further embodiment, the moving device exerts a controllable force on the excavating head in step (b). This embodiment has the advantage that the force with which the excavating head presses on the soil is controlled by means of the hoisting device. When excavating a channel using an excavating device which is fitted with a liquid jetting device, it is often important to accurately dose the force with which the excavating head presses on the ground. When the soil is loosely packed and the excavating head is pressed into the soil with too much force, there is a risk of the grain skeleton becoming more densely packed, as a result of which the soil will become more or less fluid (fluidization). As a result, the excavating head may become blocked. If the excavating head is pressed into the soil with too little force, there is a risk that the soil is dug out too far in front of the excavating head, as a result of which soil will flow from the side to the digging site, resulting in an instable excavation. In this embodiment, these phenomena can be substantially prevented.

In a further embodiment, filling material is placed into a return space created behind the excavating head, as seen in the direction opposite to the excavating direction, in step (c). If the excavating head moves back to the starting point of the channel in step (c), a return space is created behind the excavating head. In this space, there is a risk of the channel collapsing. By filling this space with filling material, this risk is prevented in an advantageous manner.

Preferably, the filling material is concrete. This concrete will gradually set and thus form a permanent, rigid construction in the channel.

In another embodiment, the filling material is bentonite. As has already been indicated above, bentonite is a suitable supporting liquid. If the space is filled with a supporting liquid, there will be instances where the channel produced will be completely filled with the supporting liquid when the excavating head has returned to the starting point. When the excavating head has reached the starting point and has been removed completely from the channel, the channel produced can be treated further.

In yet another embodiment, the excavating direction is substantially vertical, the supporting device being a construction element which is to be fitted in the channel, and an assembly comprising the construction element and an excavating head attached to the bottom thereof being moved downwards in step (b). In this manner a construction element can be brought into the soil in a simple manner. The construction element may be a construction element which is to be fitted permanently in the excavation.

It is also possible to extend the construction element at the top during the excavation, for example by in each case producing a predetermined length of the construction element by means of formwork and concrete.

In another embodiment, a cavity extends through the construction element in the excavating direction from a bottom opening in the bottom of the construction element adjoining the excavating head to a top opening in the construction element which is above ground in the final position, the return part being moved in the direction of the top opening through the cavity in step (c). Thus, it is possible to incorporate the excavating head in a construction element which is to be disposed in the earth. In this case, the construction element may be permanent. As the excavating head is on the bottom of the construction element, it will not readily be possible to move the excavating head or part thereof back to the starting point of the channel once the end point has been reached. The cavity enables in an advantageous manner that at least part of the excavating device can be moved back to the starting point. The top opening may be on the upper side of the construction element. It is also possible for the top opening to be located in a side wall of the construction element, between the upper side and the bottom. Preferably, the top opening is above ground when the construction element reaches its final position.

In a further advantageous embodiment, the construction element presses the excavating head down in step (b). If the construction element itself pushes the excavating head, no separate device is required in order to cause the excavating head to exert a force on the soil.

Yet another embodiment comprises fitting a connecting means through the cavity between the top opening and the excavating head, connecting the connecting means to the return part of the excavating head, and moving the return part to the top opening through the cavity by means of the connecting means in step (c). In this manner, the return part can be pulled through the cavity in a simple manner. To this end, it may be necessary to uncouple the return part from the excavating head first. However, it is also possible that the return part is connected to the excavating head in such a manner that it can be pulled up by itself.

In yet another embodiment, the excavating device comprises a liquid jetting device for generating the jet of liquid, the return part comprising at least part of the liquid jetting device in step (c). The liquid jetting device, in particular the jetting lance thereof, is often a valuable part of the excavating device and it is therefore worth retrieving that part in particular.

In another embodiment, the excavating device comprises a liquid supply line for supplying a liquid to the excavating head and a mixture discharge line for discharging the mixture from the excavating head, the liquid supply line and the mixture discharge line being moved to the starting point of the channel in step (c).

The liquid supply line and the mixture discharge line form a part of the excavating device which is of considerable economic value. This embodiment has the advantage that exactly those parts of the excavating device are retrieved. It is also possible for the liquid supply line and the mixture discharge line to be used as pulling element in order to pull the return part to the starting point in step (c). In step (b), the liquid supply line and the mixture discharge line supply liquid and discharge mixture, respectively, and in step (c), the liquid supply line and the mixture discharge line act as pulling element.

In yet another embodiment, the construction element is constructed by adding in each case one construction element to a row of construction elements in step (b) at the starting point, and in each case displacing the row of construction elements in the excavating direction in step (b). This is a simple and reliable method of producing a construction element. It is important in this case that space is left for the liquid supply line and the mixture discharge line, so that the excavating device can operate well. To this end, the construction elements may comprise recesses in order to leave room for the liquid supply line and the mixture discharge line and any other lines, for example for measuring and controlling. The construction elements may be produced beforehand and added immediately to the row of construction elements. It is also possible for a construction element to be produced in situ, that is to say at the location. This may be effected, for example, by in each case providing formwork at the top of the row of construction elements, in which formwork the construction element is produced with the aid of concrete. The recess in the construction element may be achieved using a mould in the shape of a tube.

With yet another method, an excavating head is provided in step (a) which is fitted with a number of liquid jetting devices, the liquid jetting devices together forming a cross-section of the channel to be produced.

In this manner, it is possible to create cross-sections of different shape. It is, for example, possible to produce a substantially circular cross-section, a rectangular or a square cross-section.

In an alternative embodiment, the liquid jetting devices together form an annular cross-section. In this manner, only a profile of walls of a channel to be produced is excavated. An inner part of the channel is not excavated. In this manner, a tubular channel is created, the inner part of which still consists of soil. Optionally, this inner part can be excavated later.

In a further embodiment, the method as described above is used for producing a channel in the sea floor. The method is particularly suitable for producing blind, substantially vertical channels in the sea floor, in order to form a foundation for structures to be built on. In this manner, construction elements with a large cross-section can be created, for example for supporting a windmill at sea, or for supporting another structure.

The invention also relates to an excavating device for producing a blind excavation in the excavating direction in the ground, the channel to be produced extending between a starting point and an end point, and the excavating device comprising: (a) an excavating head, comprising: a liquid jetting device which is designed for loosening the soil using a jet of liquid from the excavating head in the excavating direction in order to form a mixture of soil and liquid; and a mixture discharge device for discharging the mixture from the excavating head to the starting point; (b) a moving device for moving a return part of the excavating device against the excavating direction to the starting point of the channel after the end point of the channel has been reached.

The moving device may for example be a reel with a cable which pulls the return part back to the starting point. The moving device may however also be a rail along which the return part moves back to the starting point. Other moving devices are also possible.

Using the excavating device, blind channels can be produced in the soil in an advantageous manner, a part of the excavating device, the return part, being retrieved in order to be reused.

Preferably, the excavating device comprises a return part and an expendable part, the return part and the expendable part being connected to one another by a disconnectable coupling.

By means of the coupling, it is possible for the return part and the expendable part to be uncoupled in the soil, following which the return part can be moved to the starting point.

Preferably, the liquid jetting device is connected to the excavating head by means of a disconnectable coupling, the moving device being designed to move at least a part of the liquid jetting device in the disconnected state to the starting point of the channel. As the liquid jetting device may be valuable, it is advantageous from a cost point of view to retrieve this part of the excavating device.

Preferably, the mixture discharge device is connected to the excavating head by means of a disconnectable coupling, the moving device being designed to move at least a part of the mixture discharge device in the disconnected state to the starting point of the channel. The mixture discharge device may be a valuable device as it often comprises one or more pumps. According to this embodiment, it is exactly the mixture discharge device which can be retrieved.

In a preferred embodiment, the excavating head comprises a protuberance arranged near the front thereof, which extends substantially around the excavating head. This achieves the result that the cross-section of the channel is larger than the cross-section of the part of the excavating device which is behind the protuberance, viewed in the excavating direction. This creates a clearance between the part of the excavating device lying behind the protuberance and the soil adjoining the channel. This has the advantage that when the excavating head is moved, less friction is created between the part of the excavating device lying behind the protuberance and the soil.

Preferably, the excavating device comprises a liquid filling device for filling a clearance to be produced between the supporting construction to be fitted and the soil adjoining the channel with a filling liquid. The clearance can be filled with filling liquid using the liquid filling device.

Preferably, the excavating device is substantially vertical, and the moving device comprises a hoisting device which is mounted near the starting point, the excavating head being suspended from the hoisting device by means of a hoisting means. The excavating head can be lowered and raised in a simple manner by means of the hoisting device.

The words "mounted near the starting point" should be interpreted broadly. If the excavating device is being used at sea, for example, the water may be several tens of metres deep. The starting point of the channel is then at the level of the seabed. If, for example, a crane ship is used, the hoisting device itself will be several tens of metres above sea level, and thus at some distance from the starting point of the channel. Preferably, the hoisting device is above the starting point of the channel.

Preferably, the excavating device comprises a filling device for filling a return space created behind the excavating device with filling material while the excavating device is being moved against the excavating direction. Using the filling device, the space can be filled in a simple manner.

Preferably, the mixture discharge device comprises a mixture discharge line for discharging the mixture of the excavating head to the starting point, the mixture discharge line forming part of the return part. This embodiment has the advantage that the mixture discharge device, which is usually also valuable, can also be retrieved.

Preferably, the mixture discharge device comprises an air supply device for supplying air near the excavating head to the mixture discharge line. Thus, the mixture can be discharged using simple means. The air bubbles move up in the mixture discharge line and carry the mixture along and upwards in the process.

In a preferred embodiment, the filling device and the mixture discharge device are one and the same. This means that a separate filling device and mixture discharge device can be dispensed with. When the mixture is being discharged, the conveying direction of the mixture will be from the excavating head to the starting point, and when the return space is being filled, the conveying direction of the filling material will be from the starting point to the excavating head. It is also possible for the liquid supply device and the filling device to be one and the same.

The invention also relates to an assembly comprising an excavating device and a construction element, the excavating device being fitted to the underside of the construction element. Thus, it is possible to place a construction element in the earth in a simple manner. The construction element is preferably designed to support a superstructure to be placed onto the construction element near the starting point. Combining the excavating device and the construction element has the advantage that the construction element can be installed in the earth in a simple manner.

In one preferred embodiment, the construction element and the excavating device are substantially tubular. For foundations, this shape has the advantage that horizontal forces and bending moments can be absorbed equally in all directions. This shape is, for example, outstandingly suitable for laying a foundation for structures such as windmills on the sea floor.

Preferably, the construction element comprises a cavity which extends through the construction element from a bottom opening in the bottom of the construction element abutting the excavating head to a top opening in the construction element lying above ground in the final position, a connecting means extending through the cavity between the top opening and the return part, and the excavating device being designed for moving the return part through the cavity to the top opening by means of the connecting means.

The top opening may be situated at the top of the construction element so that the cavity extends through the construction element in the vertical direction. The top opening may, however, also be situated at a location on the side wall of the construction element, between the top and the bottom of the construction element. In that case, the cavity only extends over the part of the height of the construction element between the bottom and the top opening. It is important that, in the final position of the construction element, the top opening of the cavity is above ground, so that the cavity is accessible in order to move the return part through the cavity. This embodiment achieves displacement of the return part through the construction element to the starting point in an advantageous manner.

Further preferred embodiments of the device are described in the claims. The invention will be described in more detail below with reference to the attached, non-limiting drawing, in which:

Figure 5A:
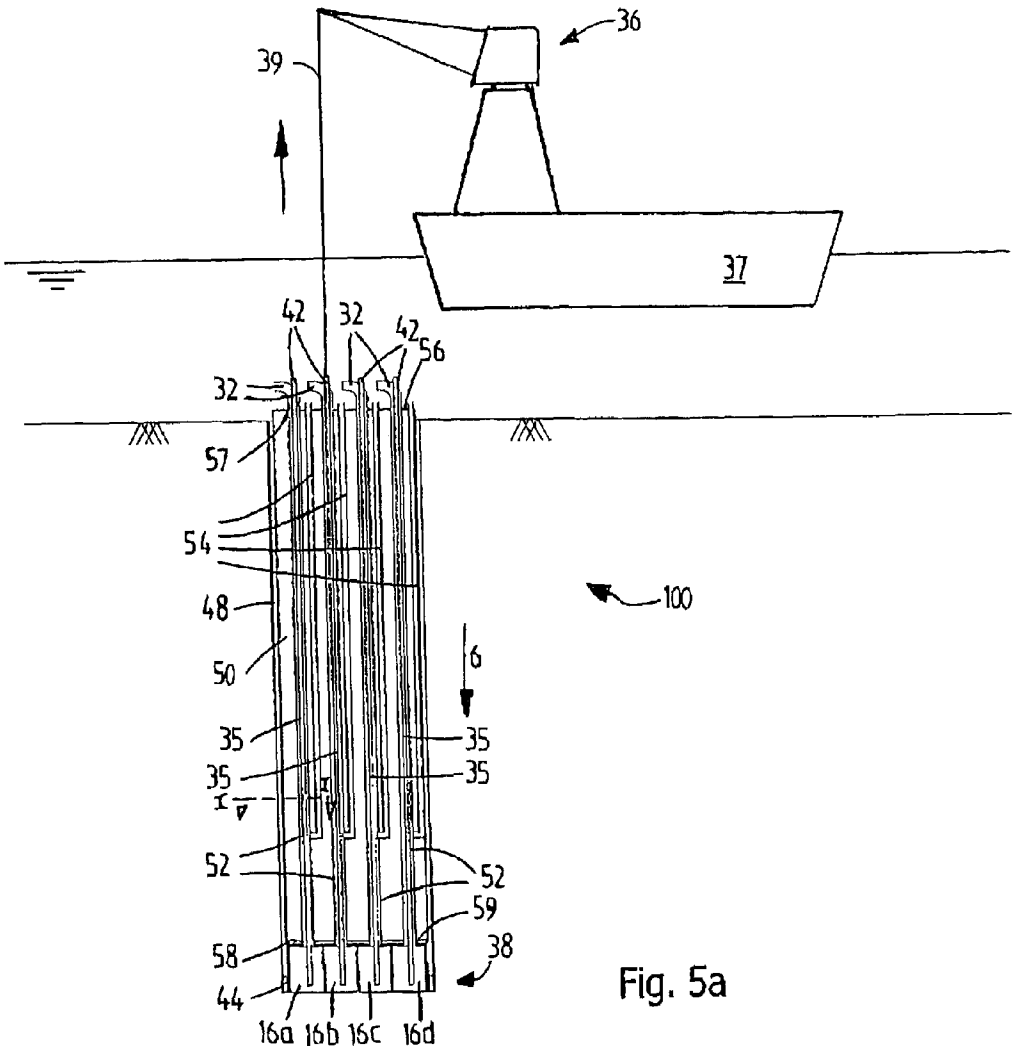
Figure 5B:
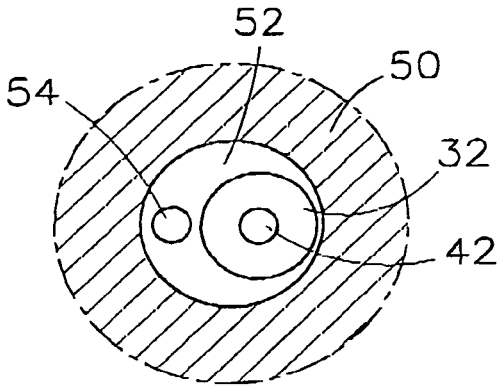
Figure 5C:
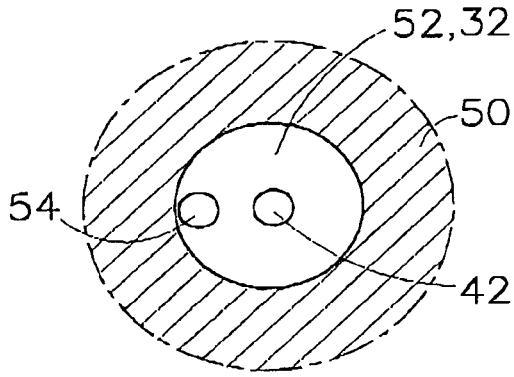
Figure 5D:
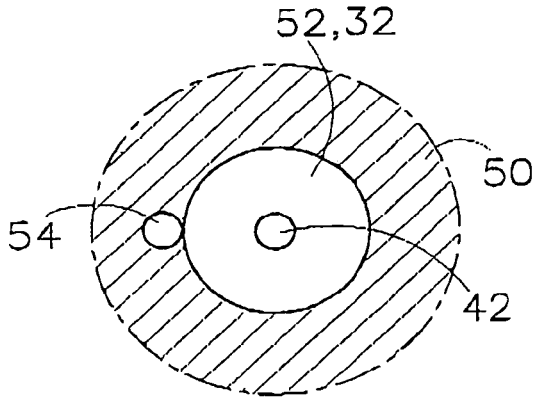

FIG. 5*a* shows a diagrammatic cross-section of yet another embodiment according to the invention;

FIGS. 5*b*, 5*c* and 5*d* show diagrammatic cross-sections of the lines along line I-I in FIG. 5*a;*

Figure 6A:
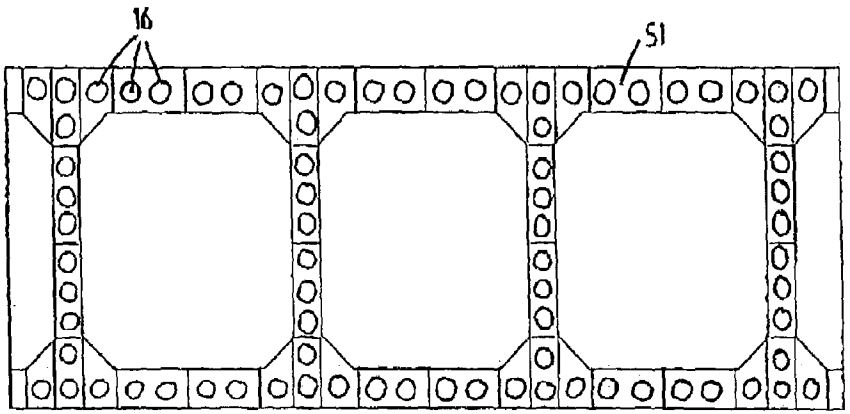
Figure 6B:
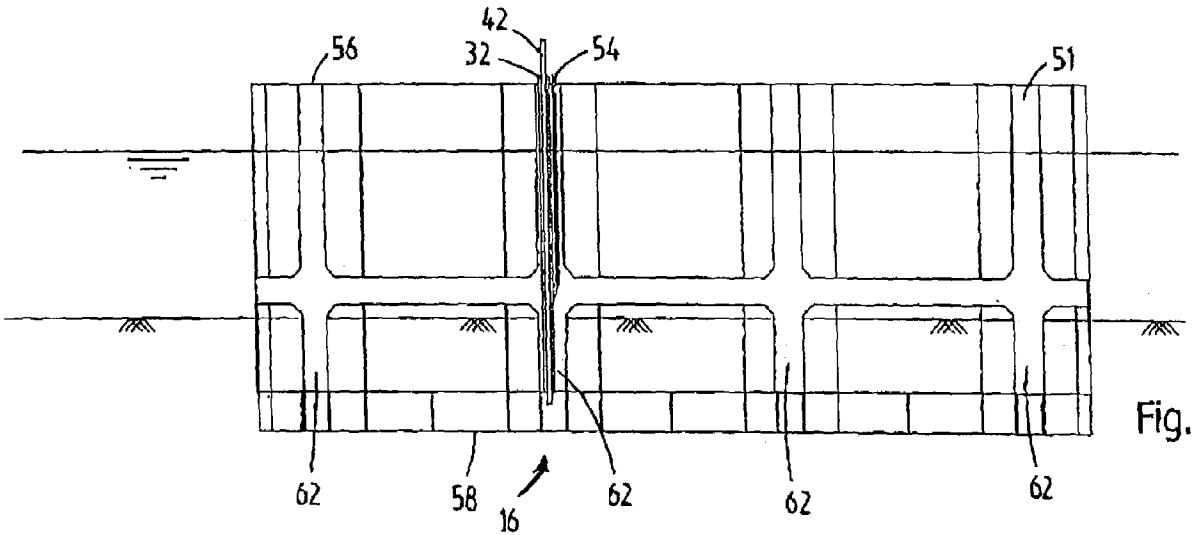

FIG. 6*a* shows a diagrammatic plan view of a further embodiment according to the invention;

FIG. 6*b* shows a diagrammatic cross-section of the embodiment of FIG. 6*a;*

Figure 7:
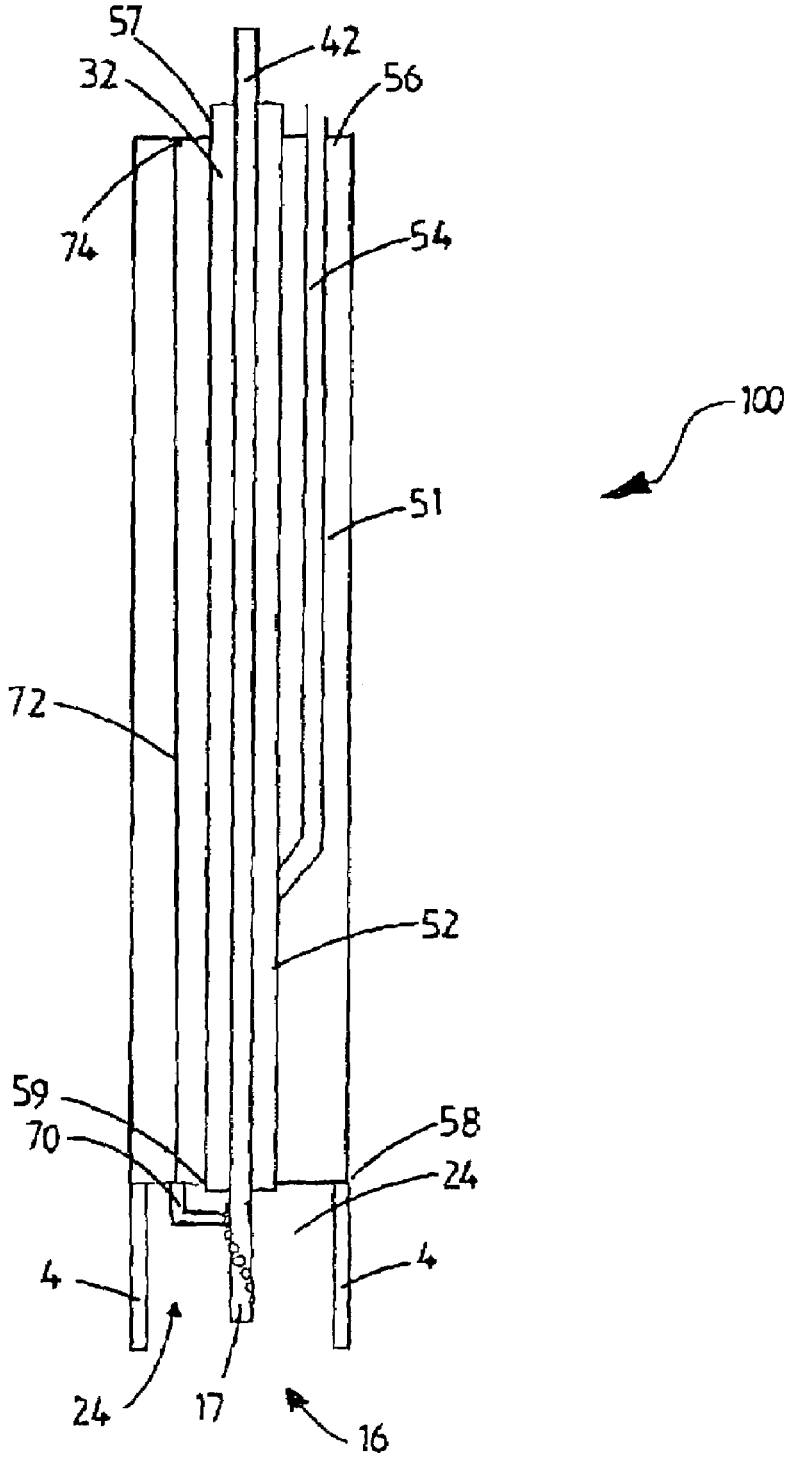

FIG. 7 shows a detailed diagrammatic cross-section of the embodiment according to FIGS. 6*a* and 6*b;*

Figure 8B:
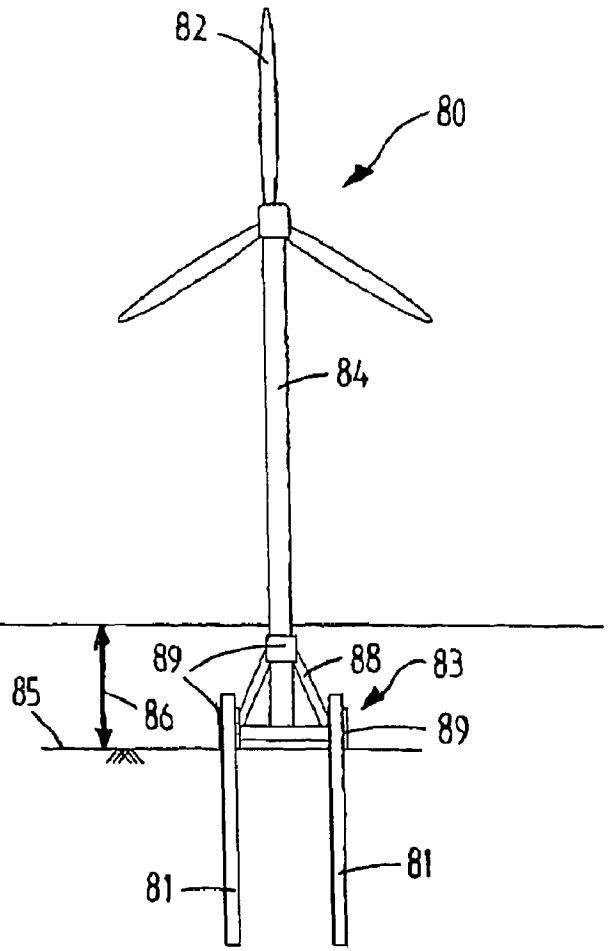
Figure 8A:
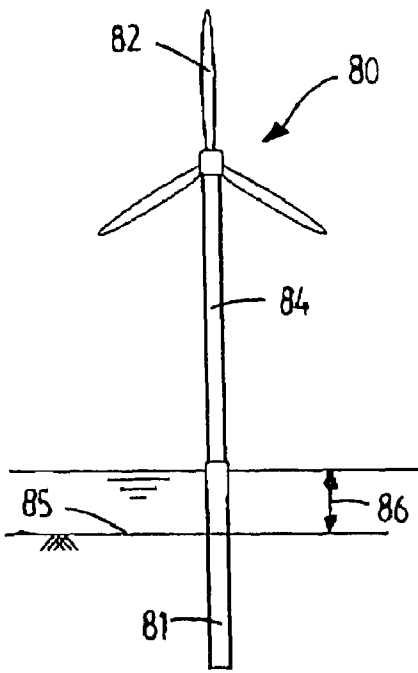
Figure 9B:
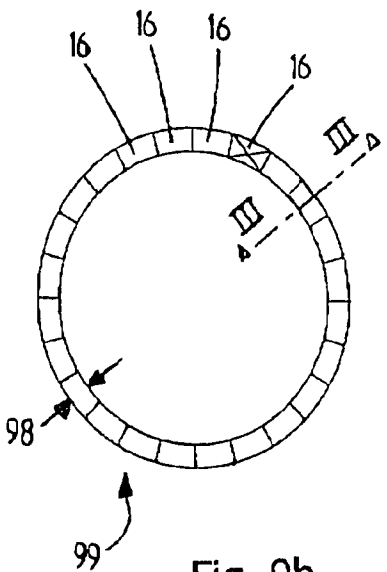
Figure 9A:
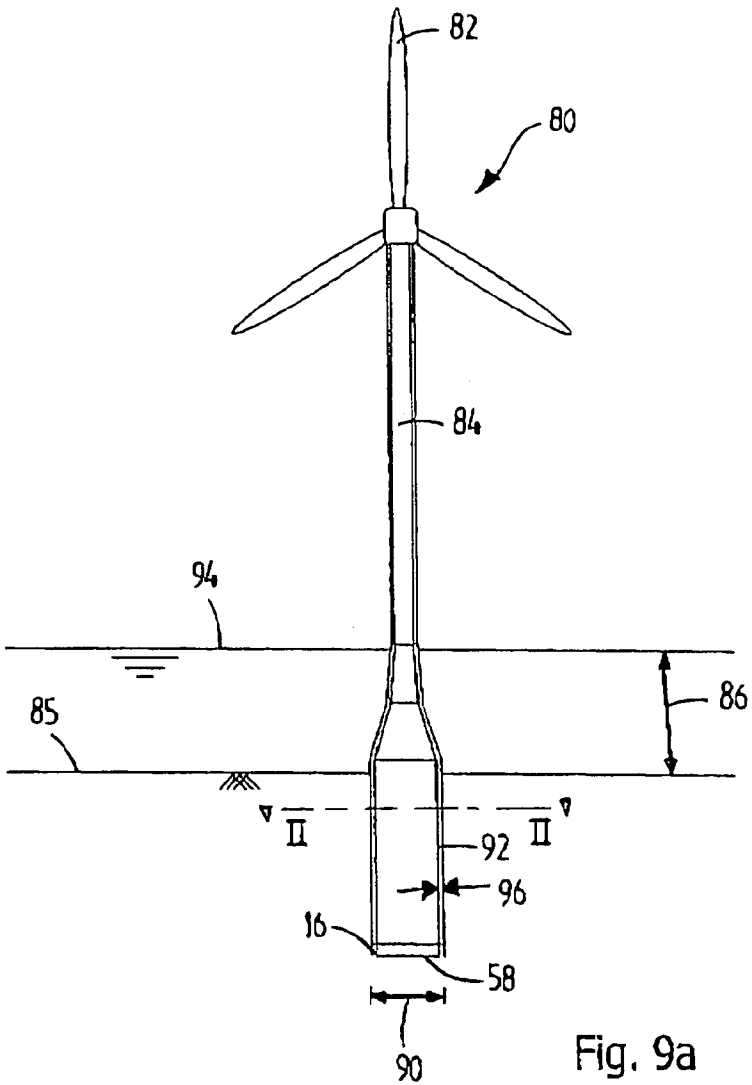
Figure 10B:
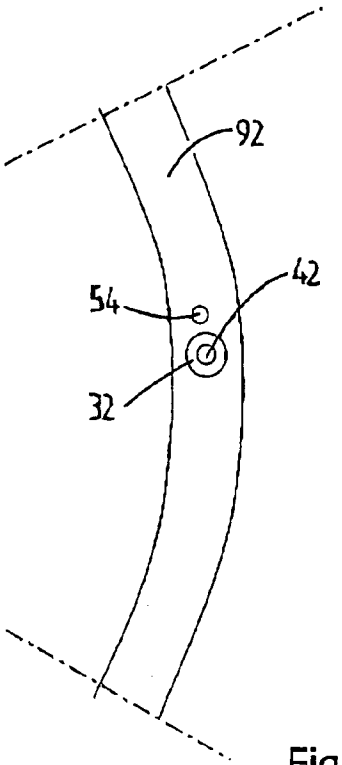
Figure 10A:
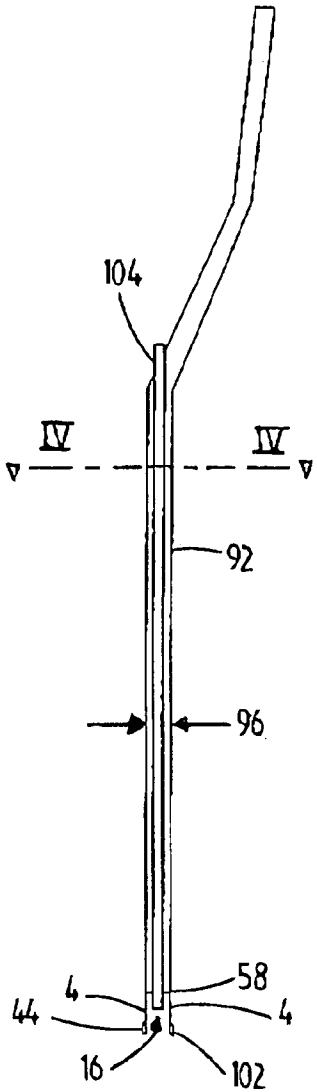

FIGS. 8*a* and 8*b* show a diagrammatic representation of foundations for windmills at sea according to the prior art;

FIG. 9*a* shows a diagrammatic cross-section of a foundation of a windmill at sea according to the invention;

FIG. 9*b* shows a diagrammatic cross-section of the embodiment according to FIG. 9*a*, along line II-II;

FIG. 10*a* shows a detailed diagrammatic cross-section of the embodiment of FIGS. 9*a* and 9*b*, along line III-III in FIG. 9*b;*

FIG. 10*b* shows a detailed diagrammatic cross-section of the embodiment of FIG. 10*a*, along line IV-IV in FIG. 10*a*; and FIGS. 11*a*, 11*b*, 11*c*, 11*d* and 11*e* show diagrammatic representations of various possible cross-sections of the channel, produced by an excavating device according to the invention having several liquid jetting devices.

Identical reference numerals refer to identical components, or components having the same or an identical function. Arrows without reference numerals indicate movement directions of components.

Figure 1:
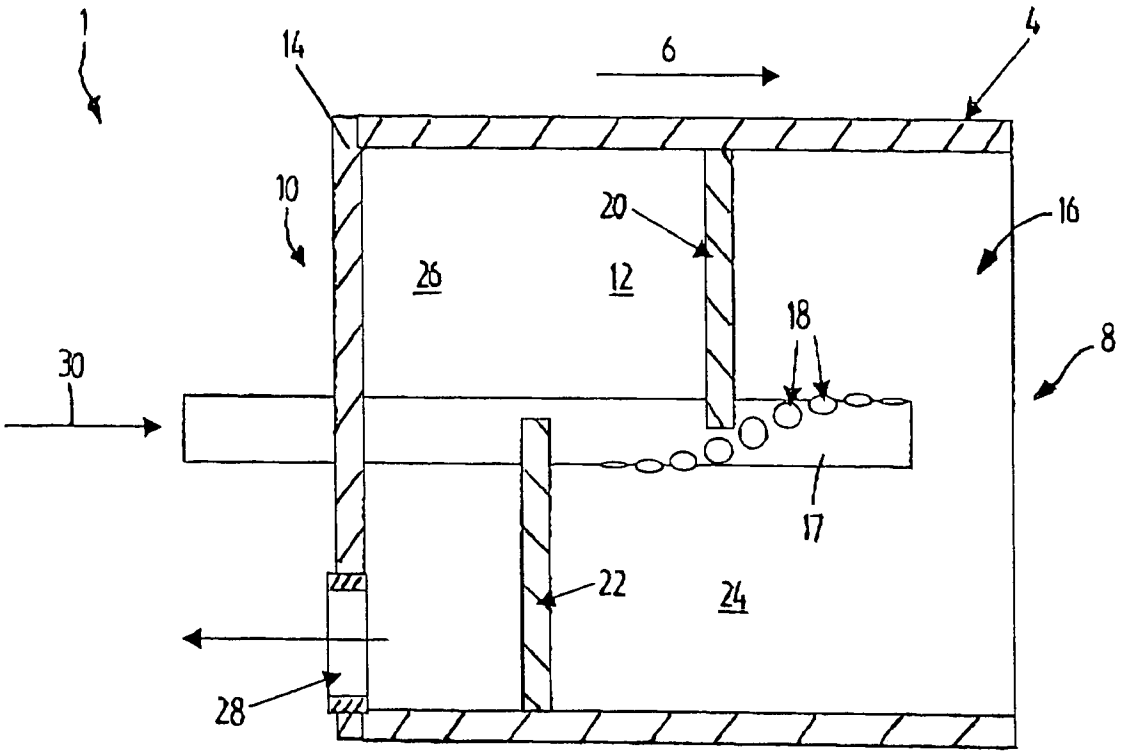
Fig. 1 Prior Art
FIG. 1 shows a diagrammatic cross-section of an excavating device according to the prior art.

FIG. 1 shows an excavating device from the prior art having a liquid jetting device 16 from the prior art. The excavating device 1 comprises a wall 4, which forms a continuous peripheral wall around the excavating device 1. The excavating device 1 has a front 8 and a rear 10. The excavating device 1 is open at the front 8. A wall 4 defines an interior space 12. A rear wall 14 adjoins the wall 4 and thus defines the rear 10 of the excavating device 1. A jetting lance 17 is arranged in the interior space 12, which jetting lance is provided with liquid outflow openings 18. There are a number of liquid outflow openings 18 and they are arranged in the shape of a helix on the jetting lance 17, viewed in the excavating direction 6. The liquid outflow openings 18 are arranged on the jetting lance 17 in such a manner that the jets of liquid from the liquid outflow openings 18 cover the cross-section of the excavation chamber 24 evenly in all directions. Two fixed partitions 20 and 22 are securely connected to the wall 4 in a direction which is substantially at right angles to the excavating direction 6. The partitions 20 and 22 thus define the excavation chamber 24 and a mixing chamber 26. The rear wall 10 comprises a mixture discharge opening 28 which is connected to a mixture discharge line (not shown).

During operation, a liquid, for example water, will be supplied to the jetting lance 17 by means of a liquid supply line (not shown). The liquid (not shown) is sprayed from the liquid outflow openings 18 with force. As a result, soil (not shown) will be loosened and mixed with water. During operation, the mixture (not shown) will flow over the partition 22 into the mixing chamber 26 and be discharged from the mixing chamber 26 via the mixture discharge opening 28. Simultaneously or for example intermittently, the excavating device 1 will be advanced in the excavating direction 6, thereby producing a channel in the earth.

Figure 2:
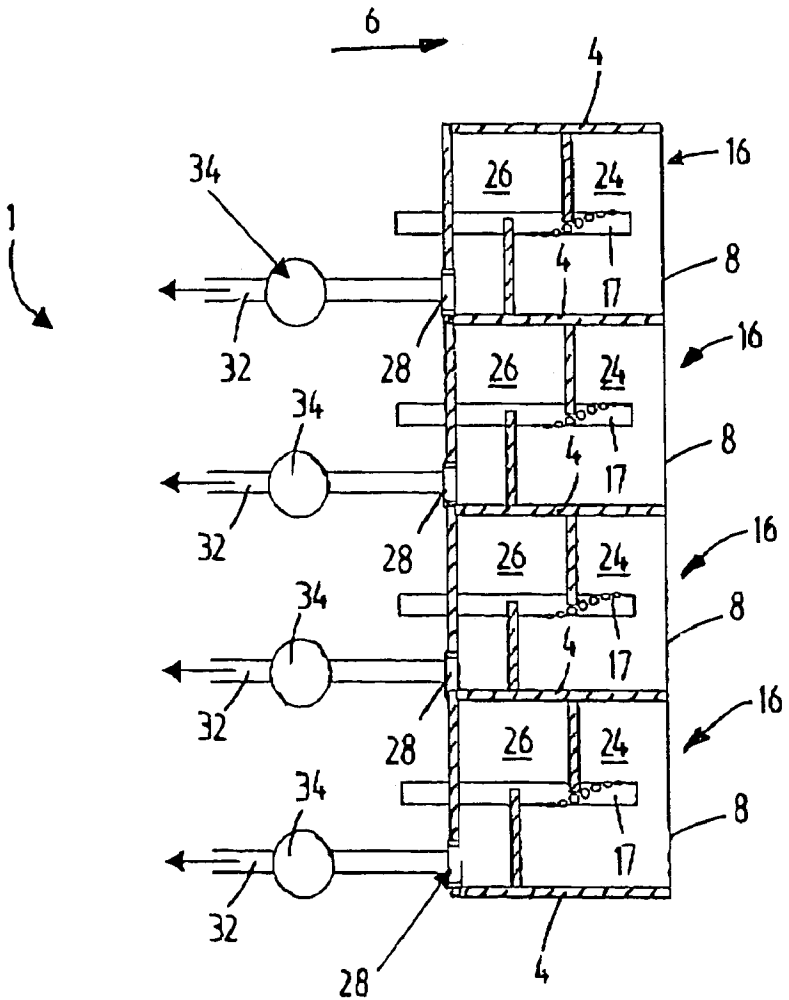
Fig. 2 Prior Art
FIG. 2 shows a diagrammatic cross-section of another excavating device according to the prior art.

FIG. 2 shows an excavating device 1 from the prior art which comprises a number of liquid jetting devices 16. The liquid jetting devices 16 are arranged adjacent to one another, each with its open front 8 in the direction of the excavating direction 6. In this case, the walls 4 of the liquid jetting devices 16 abut one another. Each liquid jetting device 16 comprises a jetting lance 17, an excavation chamber 24, and a mixing chamber 26. Each liquid jetting device 16 also comprises a mixture discharge opening 28 which is connected to respective mixture discharge lines 32. Each mixture discharge line 32 has a pump 34.

During operation, liquid is supplied to the liquid jetting device 16 and the liquid is sprayed from the respective liquid outflow openings 18 of the respective jetting lances 17 with force. The jets of liquid loosen soil and this soil is mixed with the water. The mixture (not shown) ends up in the mixing chamber 26 and is discharged from the mixing chamber 26 by means of the mixture discharge line 32. The respective pumps 34 in this case pump the mixture to the starting point of the channel.

Figure 3:
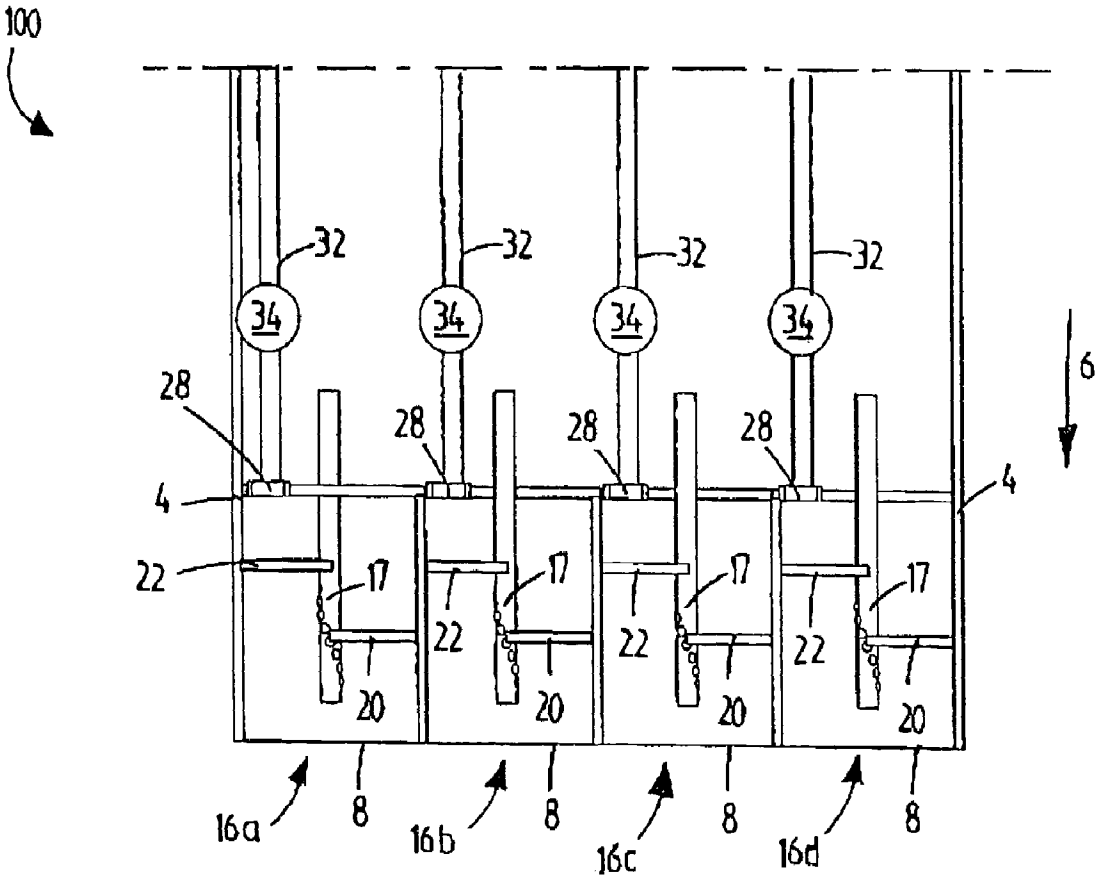
FIG. 3 shows a diagrammatic cross-section of an embodiment according to the invention.

FIG. 3 shows the excavating device 100 according to the invention. The excavating device 100 comprises four liquid jetting devices 16*a*, 16*b*, 16*c*, 16*d*. The liquid jetting devices 16*a* to 16*d* each have a bottom 8, the bottom 8 being directed downwards, in the direction of the excavating direction 6. Each liquid jetting device comprises a jetting lance 17, a mixture discharge line 32, a pump 34 and partitions 20 and 22. It is possible for the mixture discharge lines 32 to converge to form one common mixture discharge line (not shown) and that only one pump (not shown) is used for discharging the mixture from all liquid jetting devices 16*a* to 16*d*. If there is no risk during operation of the soil blocking the respective mixture discharge openings 28, the partitions 20, 22 can be dispensed with.

The liquid jetting devices 16 may be arranged in a variety of configurations. This will be illustrated below in more detail in FIGS. 11*a* to 11*d*. It will be clear to those skilled in the art that there are similarities between the excavating device 100 of FIG. 3 and the excavating device 1 of FIGS. 1 and 2. One difference is that the open side 8 of the excavating device 100 is directed downwards, while the open side 8 of the excavating device 1 is directed sideways.

This means, that during operation, the weight of the excavating device 100 will be directed in the excavating direction 6. It is possible to control the force which is exerted on the soil in the excavating direction 6 by the excavating device 100.

If a channel was produced during operation and the excavating device 100 has reached the end point of the channel, at least part of the excavating device 100 will be displaced in the direction of the starting point of the channel. A moving device (not shown) is provided to this end, which moving device will be explained in more detail in the following figures.

Figure 4:
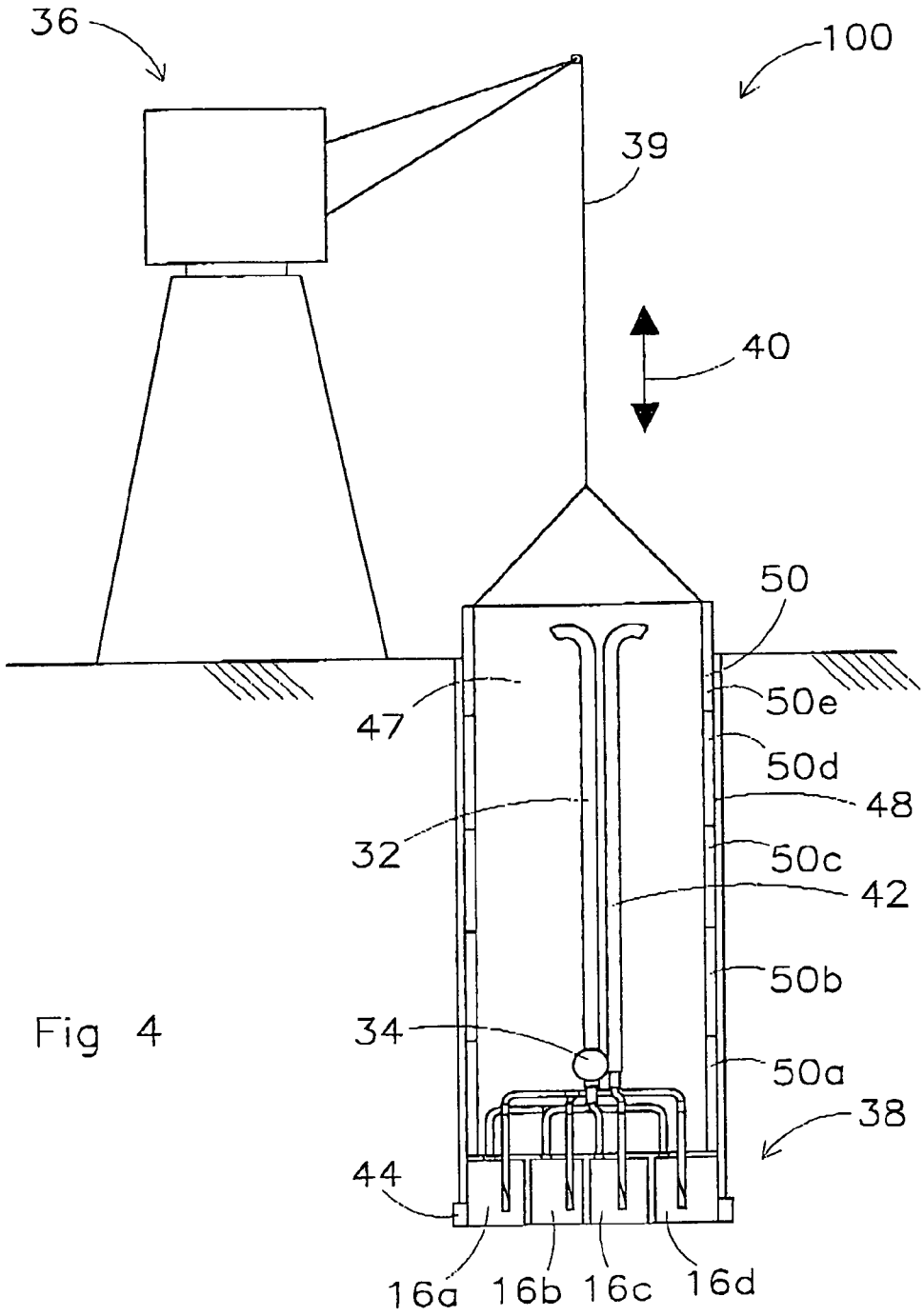
FIG. 4 shows a diagrammatic cross-section of another embodiment according to the invention.

FIG. 4 shows an embodiment of the excavating device 100 according to the invention, the excavating device 100 comprising a hoisting device 36. The excavating device 100 also comprises an excavating head 38. The excavating head 38 is suspended from the hoisting device 36 by means of a hoisting means 39, for example a cable. The excavating head 38 is provided with a protuberance 44 at its bottom around the periphery. A supporting device 50 extends between the hoisting means 39 and the excavating head 38. The supporting device 50 is annular and has a central opening 47. A liquid supply line 42 extends vertically through the central opening 47 of the top of the supporting device 50 up to the excavating head 38.

During operation, the hoisting device 36 lowers the excavating head 38. Using liquid jetting devices 16*a* to 16*d*, soil will be removed and a channel will be produced. The excavating head 38 moves in a downward direction. The protuberance 44 ensures that the channel which is being produced in the earth has a larger cross-section than the supporting device 50. In this manner, a clearance 48 is created between the soil adjoining the channel and the supporting device 50. This clearance 48 may optionally be filled with a supporting liquid, such as for example bentonite. The bentonite then acts as a means to reduce friction between the supporting device 50 and the surrounding soil and to support the earth, and to prevent the latter from moving.

When the excavating head 38 has reached the intended end point of the channel, a movement in the opposite direction will start. The hoisting device 36 will then hoist the excavating head 38 up in order to move it back to the starting point of the channel.

The supporting device 50 may be of a non-permanent nature and is then moved along with the excavating head 38 in an upward direction when the end point of the channel has been reached. In this embodiment, a space (not shown) is created under the excavating head 38 during the upward movement. This space may be filled with a supporting liquid, such as for example bentonite. In this manner, the entire channel will be filled with supporting liquid during the upward movement of the excavating head 38. The supporting liquid supports the channel wall and prevents the channel produced from collapsing.

It is also possible not to fill the space created under the excavating head during the upward movement of the excavating head 38 with a supporting liquid, but instead with a hardening material, such as concrete. This can, for example, be done when the channel will serve as a foundation for a superstructure (not shown) which is to be built thereon.

Both bentonite and concrete can be supplied by means of a separate supply line (not shown) or can be supplied by the mixture discharge line 32, or by the liquid supply line 42 and the jetting lances 17.

It is also possible for the supporting device 50 to be a construction element and to remain in the soil permanently. When the end point of the channel has been reached, the excavating head 38, or a part thereof, will be uncoupled from the construction element 50 and be moved through the central opening 47 to the starting point of the channel.

It is also possible for the supporting device to comprise a row of construction elements 50*a*, 50*b*, 50*c*, 50*d* and 50*e* in the direction of the channel to be produced. Each construction element 50*a* to 50*e* has respective cavities for each liquid jetting device 16*a* to 16*d*. In this embodiment, in the first step, the excavating head 38 is attached to the bottom of a first construction element 50*a*. In the second step, the excavating head 38 is moved downwards with the first construction element 50. When the excavating head 38 has travelled a predetermined distance, a second construction element 50*b* is placed on the first construction element 50*a*. It is possible for the excavation process to be interrupted for the placement. The second construction element 50*b* may be placed near the starting point of the channel to be produced prior to being placed. The hoisting device 36 will be uncoupled from the first construction element 50*a* and will be coupled to the second construction element 50*b*. Then, the second construction element 50*b* is placed on the first construction element 50*a*.

In this case, it may be necessary for the liquid supply line 42, the mixture discharge line 32 and the air supply line 54 to be temporarily uncoupled in order to enable placement of a next construction element 50*b*. It is also possible for the construction element 50*a* to 50*e* to comprise a number of segments. This embodiment is illustrated in more detail in FIG. 11*a*.

Here, a row of five construction elements 50*a* to 50*e* is shown. Someone skilled in the art will understand that, in practice, any other number may be chosen.

FIG. 5*a* shows an embodiment according to the invention, in which the excavating device 100 comprises an excavating head 38 which is attached to the bottom of a construction element 50. The liquid jetting devices 16*a* to 16*d* are in this case integrated with the construction element 50. For each liquid jetting device 16, a cavity 52 is provided in the construction element 50, each cavity extending from a respective top opening 57 in the top of the construction element 50 to a respective bottom opening 59 in the bottom of the construction element. For each liquid jetting device 16*a* to 16*d*, a respective mixture discharge line 32 and a respective liquid supply line 42 extend through the cavities 52. Optionally, a respective air supply line 54 may be provided for each liquid jetting device 16*a* to 16*d*.

Preferably, the moving device, such as the hoisting device 36, will be connected to the construction element 50 during the excavation process. When the end point has been reached, the moving device is uncoupled from the construction element 50. After that, the lines to be retrieved and the other components to be retrieved are moved to the top opening 57 one by one or together.

This embodiment can, for example, be used for producing substantially vertical foundations, for example on the sea floor. However, it is also possible to use this embodiment on land.

During operation, in a first step, the excavating device 100 will be positioned at the starting point of the channel to be produced. In this case, the excavating device 100 is suspended from a hoisting device 36. The hoisting device 36 may be a crane which has been placed next to or near the starting point of the channel. Other moving devices are likewise possible. The hoisting device 36 may be placed on a ship 37 while producing a channel on the sea floor, as is shown in FIG. 5. The hoisting means 39 will in this case be connected to the construction element 50.

In a second step, the excavating device 100 will produce the channel, the excavating head 38 being moved downwards, in the direction of the arrow 6. In this case, the channel is produced in a manner as has already been described above.

In a third step, the hoisting means 39 is uncoupled from the construction element 50 and connected to the top of one or more of the connecting means 35.

Subsequently, a part of each liquid jetting device 16*a* to 16*d* is uncoupled from the excavating head 38. Thereafter, the hoisting device 36 hoists the uncoupled part of the liquid jetting device 16*a* to 16*d* up by means of the hoisting means 39 on the connecting means 35, so that the uncoupled part is retrieved for re-use in an channel to be newly produced. The uncoupled parts may be moved up together or separately. The uncoupled part may comprise the following parts: the liquid supply line 42, the mixture discharge line 32, the jetting lance 17 and the air supply line 54.

Once the return part has been retrieved, it can be used for a subsequent construction element 50. The retrieved return part of the liquid jetting device 16 is fitted onto the latter again. A part of the excavating head 38, the expendable part, will thus remain behind in the earth.

It is possible, in each case, to hoist up a separate connecting means 35 with an associated uncoupled part of every liquid jetting device 16*a* to 16*d*. However, it is also possible that the connecting means 35 for each liquid jetting device 16*a* to 16*d* are coupled to each other at the top 56 of the construction element 50 by means of a fixed coupling (not shown), so that the hoisting device 36 hoists up all the connecting means 35 with the associated uncoupled parts of the liquid jetting devices 16*a* to 16*d* simultaneously. The excavating head 38 is furthermore provided with a protuberance 44 for reducing the friction between the construction element 50 and the soil during the downward movement.

FIG. 5*b* shows the liquid supply line 42, the mixture discharge line 32 and the air supply line 54 as a bundle of lines running through cavity 52, the mixture discharge line 32 enclosing the liquid supply line 42.

FIG. 5*c* shows that the cavity 52 itself can also be the mixture discharge line 32. In that case, the air supply line 54 can be inside the cavity, or outside, as is shown in FIG. 5*d*.

FIGS. 6*a* and 6*b* show an embodiment according to the invention, in which a number of liquid jetting devices are arranged on the bottom 58 of a supporting device in the form of a caisson 51 to be sunk. FIG. 6*a* shows a top view of the caisson, in which the circles indicate the locations where a liquid jetting device 16 is placed on the bottom of the caisson. Eighty liquid jetting devices 16 are thus arranged in the caisson 51 shown. The number of liquid jetting devices 16 may depend on the soil types to be dug out. With sand, the liquid jetting devices 16 may be placed a distance of 2 to 3 m apart, for example, and in clay 0.5 m, for example.

The caisson 51 has downwardly protruding caisson edges 62 on the bottom 58 of the caisson 51. The downwardly protruding caisson edges 62 are placed in rows at a distance from one another. A number of downwardly protruding caisson edges 62 extend in the transverse direction of the caisson 51 and a number of downwardly protruding caisson edges 62 extend in the longitudinal direction of the caisson 51.

During operation, in a first step, the caisson 51 is ferried or towed to the sinking location. Once it has arrived there, in a second step, the caisson 51 is slowly sunk. This sinking can be carried out in a manner known in the field, inter alia by increasing the weight of the caisson 51 and/or reducing the buoyancy of the caisson 51. When the caisson 51 sinks to the ground, the caisson edges 62 bury themselves into the ground. In this case, the liquid jetting devices 16 spray jets of liquid, such as for example water, and the mixture of soil and water which has formed is discharged via the respective mixture discharge lines 32. In this case, the caisson will slowly sink into the ground.

When the caisson 51 has reached the end point, in a third step, at least part of every liquid jetting device 16 will be uncoupled and hoisted up. This may be carried out in a manner which is analogous to the manner described in connection with the hoisting of the return parts for FIG. 5.

The manner in which the part of the liquid jetting device 16 to be uncoupled is uncoupled will be explained in more detail in the following figures.

FIG. 7 shows a detail of FIG. 6*b*, in which a liquid jetting device 16 is arranged on the bottom 58 of the caisson 51. Vertical walls 4 which protrude downwards on the bottom 58 of the caisson define the excavation space 24. The liquid jetting device 16 comprises a jetting lance 17. A cavity 52 extends vertically through the caisson 51, from the top 56 to the bottom 58 thereof. The mixture discharge line 32 and the liquid supply line 42 extend through the cavity 52. In addition, an air supply line 54 is present, which also extends in the vertical direction through the caisson 51, and opens into the mixture discharge line 32 at a location near the bottom 58 of the caisson 51.

The jetting lance 17 is connected near the bottom 58 of the caisson 51 to the caisson 51 by means of a disconnectable coupling 70. An electrical connecting line 72 is connected to the disconnectable coupling 70 for passing on electrical control signals. The connecting line 72 runs through the caisson 51 from the bottom 58 to the top 56 thereof. Near the top 58, the connecting line 72 has a connection 74, to which a control device (not shown) can be connected.

During operation, the excavating device 100 will operate in a manner as described above. When the caisson 51 has reached its desired position in the ground, a control signal will be sent to the disconnectable coupling 70 via the connecting line 72. The disconnectable coupling 70 will be uncoupled by the effect of the control signal, so that the jetting lance 17 is released from the caisson 51. Thereafter, the jetting lance 17 will be moved upward, through the cavity 52. In this manner, the jetting lance 17 is retrieved for renewed use. The coupling 70 may also be designed in a variety of other ways. If the liquid supply line 42 and the mixture discharge line 32 are rigid pipes, the coupling can also be arranged at the top of the caisson 51. The coupling 70 may also be a welded connecting plate, which is cut during uncoupling, or a bolted clamp. It is also possible to design coupling 70 as a hydraulic coupling, connecting line 72 being a hydraulic connecting line. Coupling 70 can also be a pin (not shown), which is pulled from an eye by means of a wire. Coupling 70 can also be designed as a bayonet connection or a shearing connection. It will be clear to someone skilled in the art that many other suitable embodiments of such a coupling are possible.

It is important that the coupling 70 is sufficiently strong to absorb the forces to which the jetting lance 17 is subjected during use. This may, for example, be the reactive force of a jet of liquid, or forces which are exerted by the soil or the mixture on the jetting lance 17.

FIGS. 8*a* and 8*b* show windmills provided with foundations according to the prior art at sea. FIG. 8*a* shows a windmill 80, which is founded on a single pile 81. These piles 81 are usually hollow and are usually rammed into the sea floor 85. With a windmill 80, the wind can come from various directions. The rotor 82 of the windmill 80 will usually be positioned in a direction counter to the direction of the wind. The wind will then exert horizontal forces on the rotor 82, and via the mast 84, also on the pile 81. Therefore the pile 81 has to be able to absorb horizontal forces in all directions. These forces may be considerable and vary over time. If the water depth 86 increases or the size of the windmill 80 increases, the forces exerted on the pile 81 will increase as well. A larger pile 81 will then be needed. There is, however, a maximum value with regard to the diameter of the pile. In order to prevent the wall from buckling during ramming, the wall thickness of the pile 81 has to increase as the diameter of the pile 81 increases, in order to ensure that the pile 81 is of sufficient strength. If the diameter and the wall thickness are very large, the pile 81 will be very heavy, which makes the pile very expensive in terms of material and installation. Because it has to be possible to ram the pile, it is not possible to use a stiffened plate structure as a structure for the pile 81. A stiffened plate structure of this type, with stiffening plates transverse to the wall in the axial and peripheral direction, would enable considerable savings in terms of the weight of the pile and thus material costs. However, the stiffening plates positioned transversely to the wall increase the ramming resistance to such a large degree that a pile made from stiffened plates cannot be rammed.

At a water depth of more than 25 metres, it is no longer economical to use a single pile 81. In practice, there is currently a desire to build ever larger windmills in areas with ever greater water depths.

If the maximum diameter of a pile 81 no longer suffices, a jacket structure 83 is often used in the state of the art. With a jacket structure 83, the windmill 80 is often placed on a base 88 which rests on a number of single piles 81. This number may be, for example three, but more piles 81 may also be used. According to the prior art, relatively large windmills can be founded in this manner. An important drawback with this founding method is the junction points 89 between the mast 84 and the piles 81. These junction points are subjected to forces which are great and vary over time. The junction points 89 are therefore subject to fatigue, as a result of which the junctions will be very expensive in terms of material and design.

FIGS. 9*a* and 9*b* show how the present method and device for producing a channel can be used in constructing a pile for a large windmill 80 at sea, in water with a relatively great depth 86. The diameter 90 of such a pile 92 can be much larger than the diameters which have been achieved using prior art techniques.

With a pile 92 of this type, concrete or stiffened plate may be used. This material makes it possible for the pile 92 to have a varying cross-section in the vertical direction. It is advantageous, for example, if the portion of the pile 92 which is near and in the sea floor 85 has a wide base. Here, the bending moments in the pile 92 are greatest. The portion of the pile 92 which is near the water surface 94 has a smaller cross-section, so that waves will exert only limited forces on the pile 92. The pile 92 is hollow and is provided with a ring 99 of liquid jetting devices 16 at its bottom 58, as is shown in FIG. 9*b*. The liquid jetting devices 16 are disposed on the bottom 58 of the pile 92 over its entire periphery. In FIG. 9*b*, 24 liquid jetting devices 16 are thus employed. The spacing between the liquid jetting devices 16 may be dependent on the soil type. With sand, the spacing will be greater than with clay. In the case of sand, the interval may be, for example, 2 to 3 metres. If the pile 81 has a periphery of, for example, 18 m, between 6 and 9 liquid jetting devices will be arranged in the peripheral direction. With clay, the liquid jetting devices 16 will be positioned at intervals of 0.3-1.0 m. If the pile 81 has a periphery of 18 m, 18-36 liquid jetting devices 16 will be used in the peripheral direction.

The mast 84 of the windmill 80 can be made from concrete or steel, for example.

In order to reduce the friction between the pile 92 and the channel wall during digging, the bottom 58 of the pile 92 may be provided with a protuberance (shown as number 44 in FIG. 10*a*) or protruding edge. In this way, the channel that is being produced will have a larger cross-section than the cross-section of the pile 92 above the protuberance 44. A clearance will then be created between the pile 92 and the soil, which will reduce the friction.

Alternatively, it is possible for the wall thickness 96 of the pile 92 to be smaller than the wall thickness 98 of the ring 99 of liquid jetting devices 16 at the bottom 58 of the pile 92. In this manner, a clearance can be created both on the outer periphery of the ring 99 and on the inner periphery of the ring 99. This clearance may, if desired, be filled with bentonite or a similar supporting and lubricating liquid.

FIG. 10*a* shows details of the pile 92 provided with a liquid jetting device 16. The liquid supply line 42 and the mixture discharge line 32 are here shown as a line 104. When the desired depth is reached, part of each liquid jetting device 16 is uncoupled and pulled up in a manner as has already been described above. It is also possible for an air supply (not shown) to extend through the pile 92, as has already been described above.

FIG. 10*b* shows a set of lines in cross-section along line IV-IV in FIG. 10*a*, the set comprising: the liquid supply line 42, the mixture discharge line 32 and the air supply line 54. FIG. 10*b* shows a single set of lines, but someone skilled in the art will understand from the aforegoing that a number of these sets of lines are disposed along the periphery of the pile 92 on the bottom 58 therof, one for each liquid jetting device 16.

Figure 11A:
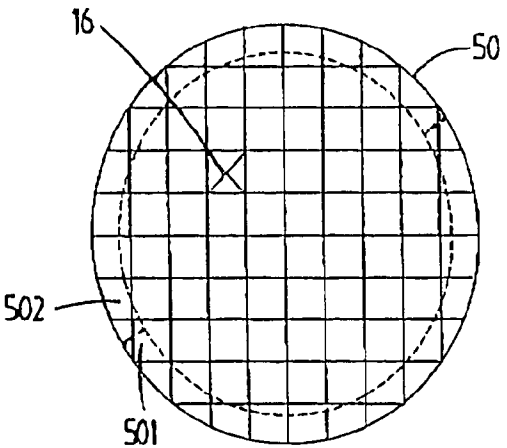

FIGS. 11*a* to 11*e* show how cross-sections of various shapes can be created by configuring the liquid jetting devices 16 inside an excavating head 38 in different ways. The shape of the cross-section can be chosen more or less freely. FIG. 11*a* shows a substantially circular cross-section of a channel.

FIG. 11*a* also shows two segments 501, 502 of a construction element 50. It may be advantageous to use a number of segments 501*a* and 502*a* which are placed against each other and are possibly connected to one another. The segments 501*a* and 502*a* thus jointly form an annular construction element 50. This has the advantage, for example, that any lines present in the central opening of the ring do not form an obstruction during placement of the construction element 50. It will be clear to someone skilled in the art that a larger number of segments than two can be used.

Figure 11B:
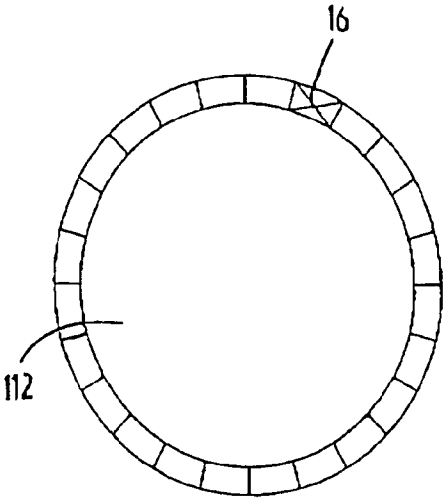

FIG. 11*b* shows an annular cross-section, formed by a number of liquid jetting devices 16 arranged in a ring shape.

Figure 11C:
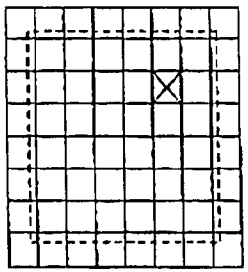
Figure 11D:
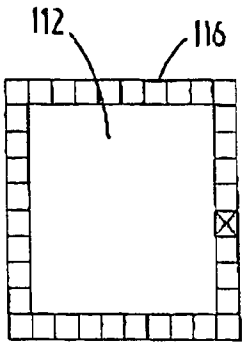
Figure 11E:
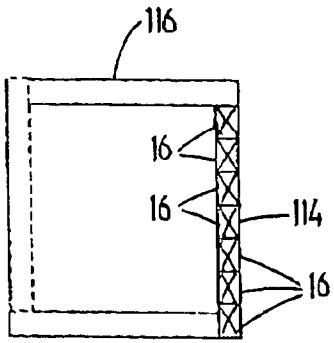

FIG. 11*c* shows a substantially square shape. FIG. 11*d* shows a square shape 116 having an open inside. The inside is not dug out during production of the channel. Once the channel has been produced, the inside 112 can be dug out. However, it is also possible not to dig out the inside 112 of the channel. FIG. 11*e* shows a variant of the invention, a square 116 with an open inside being formed by digging out the four walls of the square 116 in succession. In FIG. 11*e*, the excavating device 100 has the form of a rectangle 114 and comprises seven liquid jetting devices 16. Using such an excavating device, it is possible to dig out a square 116 in four digging steps, the inside of which is not dug out.

The invention claimed is:

1. Method for making a blind channel in the ground in an excavating direction, wherein the channel which is to be made extends between a starting point and an end point, the method comprising the following steps:

(a) positioning an excavating device comprising an excavating head at the starting point, the excavating head comprising:

a returnable part which comprises a liquid jetting device configured for loosening soil in the excavating direction with the aid of a jet of liquid for forming a mixture of soil and liquid, an excavation chamber in which the mixture of soil and liquid is formed by the liquid jetting device, a mixing chamber from which the mixture of soil and liquid is discharged via a mixture discharge line by a mixture discharge device, the mixing chamber being separated from the excavation chamber by at least one partition, the partition defining an opening for allowing the mixture of soil and liquid to flow from the excavation chamber into the mixing chamber;

(b) advancing the excavating head in the excavating direction, wherein soil is loosened at the excavating head in the excavating direction with the aid of the jet of liquid for forming the mixture of soil and liquid in the excavation chamber, wherein the mixture is discharged from the excavation chamber to the mixing chamber through the opening in the partition and from the mixing chamber to the starting point of the channel by the mixture discharge device; and (c) moving the returnable part of the excavating device to the starting point of the channel after the end point of the channel which is to be made has been reached, and leaving the excavation chamber and the mixing chamber behind.

2. Method according to claim 1, wherein the excavating device comprises a returnable part and an expendable part, the returnable part and the expendable part being uncoupled in step (c), prior to moving the returnable part to the starting point of the channel.

3. Method according to claim 1, in which the excavating direction has a downward component, and the excavating direction is preferably substantially downwards.

4. Method according to claim 1, in which in step (b) a supporting device is arranged behind the excavating head, viewed in the excavating direction, in order to support the soil adjacent to the channel.

5. Method according to claim 4, in which, in step (b), the supporting device is moved in the excavating direction.

6. Method according to claim 5, in which in step (b) the supporting device fitted has a smaller cross-section than the channel produced.

7. Method according to claim 6, in which, in step (b), a filling liquid is introduced in a clearance between the supporting device and the soil adjoining the channel.

8. Method according to claim 1, in which a moving device is provided near the starting point, and in which the returnable part is moved to the starting point of the channel by the moving device after the end point of the channel has been reached.

9. Method according to claim 8, in which the moving device comprises a hoisting device, and in which in step (a) the excavating head is suspended from the hoisting device, wherein in step (b) the hoisting device lowers the excavating head, and wherein in step (c) the hoisting device hoists the excavating head up.

10. Method according to claim 8, in which in step (b) a supporting device is arranged behind the excavating head, viewed in the excavating direction, in order to support the soil adjacent to the channel, and in which the moving device engages with the supporting device.

11. Method according to claim 8, in which the moving device exerts a controllable force on the excavating head in step (b).

12. Method according to claim 1, in step (c) which a filling material is placed into a return space created behind the excavating head, as seen in the direction opposite to the excavating direction.

13. Method according to claim 4, in which the excavation direction is substantially vertical, in which the supporting device is a construction element which is to be fitted permanently in the channel, and in which an assembly comprising the construction element and an excavating head attached to the bottom thereof is moved downwards in step (b).

14. Method according to claim 13, in which a cavity extends through the construction element in the excavating direction from a bottom opening in the bottom of the construction element adjoining the excavating head to a top opening in the construction element which is above ground in the final position, in which the returnable part is moved in the direction of the top opening through the cavity in step (c).

15. Method according to claim 13, in which the construction element presses the excavating head down in step (b).

16. Method according to claim 14, further comprising: fitting a connecting means through the cavity between the top opening and the excavating head, connecting the connecting means to the returnable part of the excavating head, and moving the returnable part in the direction of the top opening through the cavity by means of the connecting means in step (c).

17. Method according to claim 1, in which the excavating device comprises a liquid supply line for supplying the liquid to the excavating head and a mixture discharge line for discharging the mixture from the excavating head, in which the liquid supply line and the mixture discharge line are moved to the starting point of the channel in step (c).

18. Method according to claim 13, in which the construction element is constructed by repeatedly adding one construction element to a row of construction elements in step (b) at the starting point, and in which the row of construction elements is repeatedly displaced in the excavating direction in step (b).

19. Method according to claim 1, in which an excavating head is provided in step (a) which is fitted with a number of liquid jetting devices, in which the liquid jetting devices together form a cross-section of the channel to be produced.

20. Method according to claim 19, in which the liquid jetting devices together form an annular cross-section.

21. Method according to claim 1, used for producing a channel in seabed.

22. Method according to claim 1, in which the excavating direction is substantially downwards and in which during step b) the mixing chamber is located substantially above the excavation chamber.

23. Method according to claim 1, in which in step b) the liquid jetting device is located at least partially in the excavation chamber and wherein in step c) the liquid jetting device is moved out of the excavation chamber and at least partially through the mixing chamber to the starting point of the channel.

24. Method according to claim 1, wherein the excavating head comprises at least a forward partition part and a rear partition part which separate the excavation chamber from the mixing chamber, wherein the forward partition part is provided more forward relative to the rear partition part as viewed in the excavating direction, and wherein the opening between the excavation chamber and the mixing chamber is defined between the forward partition part and the rear partition part.

25. Method according to claim 1, wherein in step b) a direction of the flow of the mixture of soil and liquid through the opening is substantially transverse to the excavating direction.

26. Excavating device for making a blind channel in the ground in an excavating direction, in which the channel to be produced extends between a starting point and an end point, and in which the excavating device comprises:

(a) an excavating head, comprising:

a returnable part which comprises a liquid jetting device which is configured for loosening the soil using a jet of liquid from the excavating head in the excavating direction in order to form a mixture of soil and liquid; and an excavation chamber in which the mixture of soil and liquid is formed by the liquid jetting device, a mixing chamber from which the mixture of soil and liquid is discharged from the excavating head to the starting point via a mixture discharge line by a mixture discharge device, the mixing chamber being separated from the excavation chamber by at least one partition, the partition defining an opening for allowing the mixture of soil and liquid to flow from the excavation chamber into the mixing chamber;

(b) a moving device for moving the returnable part of the excavating device against the excavating direction to the starting point of the channel after the end point of the channel has been reached, while the excavation chamber and the mixing chamber are constructed to remain behind.

27. Excavating device according to claim 26, in which the excavating device comprises a returnable part and an expendable part, and in which the returnable part and the expendable part are connected to one another by means of a disconnectable coupling.

28. Excavating device according to claim 26, in which the liquid jetting device is connected to the excavating head by means of a disconnectable coupling, and in which the moving device is designed to move at least a part of the liquid jetting device in the disconnected state to the starting point of the channel.

29. Excavating device according to claim 26, in which the mixture discharge device is connected to the excavating head by means of a disconnectable coupling, and in which the moving device is designed to move at least a part of the mixture discharge device in the disconnected state to the starting point of the channel.

30. Excavating device according to claim 26, in which the excavating head comprises a protuberance arranged near the front thereof, which extends substantially around the excavating head.

31. Excavating device according to claim 26, in which the excavating device is designed for fitting a supporting structure, in order to support the soil adjacent to the channel.

32. Excavating device according to claim 31, in which the excavating device comprises a liquid filling device for filling a clearance to be made between the supporting construction to be fitted and the soil adjoining the excavation with a filling liquid.

33. Excavating device according to claim 26, in which the excavating direction is substantially vertical, in which the moving device comprises a hoisting device fitted near the starting point and in which the excavating head is suspended from the hoisting device by means of a hoisting means.

34. Excavating device according to claim 33, in which the hoisting force to be exerted on the excavating head is controllable.

35. Excavating device according to claim 26, in which the excavating device comprises a filling device for filling a return space created behind the excavating device with filling material while the excavating device is being moved against the excavating direction.

36. Excavating device according to claim 26, in which the mixture discharge device comprises a mixture discharge line for discharging the mixture of the excavating head to the starting point, in which the mixture discharge line forms part of the returnable part.

37. Excavating device according to claim 36, in which the mixture discharge device comprises an air supply device for supplying air near the excavating head to the mixture discharge line.

38. Excavating device according to claim 35, in which the filling device and the mixture discharge device are one and the same.

39. Excavating device according to claim 35, in which the liquid supply device and the filling device are one and the same.

40. Excavating device according to claim 35, in which the excavating device comprises a number of liquid jetting devices, which together define a cross-section of the channel to be produced.

41. Assembly of the excavating device according to claim 26 and a construction element, in which the excavating device is connected to the bottom of the construction element.

42. Assembly according to claim 41, in which the construction element is designed for supporting a superstructure to be placed onto the construction element near the starting point.

43. Assembly according to claim 41, in which the construction element and the excavating device are substantially annular.

44. Assembly according to claim 41, in which the construction element comprises a cavity which extends from the top opening in the construction element to the bottom end of the construction element abutting the excavating head, and in which a connecting means extends through the cavity between the top opening and the returnable part, and in which the excavating device is designed for moving the returnable part through the cavity to the top opening by means of the connecting means.

45. Assembly according to claim 44, in which the returnable part comprises at least a part of the liquid jetting device.

46. Excavating device according to claim 26, configured for excavating substantially downwards and in which during excavation the mixing chamber is located substantially above the excavation chamber.

47. Excavating device according to claim 26, in which in use the liquid jetting device is located at least partially in the excavation chamber and wherein the liquid jetting device is movable from the excavation chamber and at least partially through the mixing chamber to the starting point of the channel.

48. Excavating device according to claim 26, wherein the excavating head comprises at least a forward partition part and a rear partion part, wherein the forward partition part is provided more forward relative to the rear partition part as viewed in the excavating direction, and wherein the opening between the excavation chamber and the mixing chamber is defined between the forward and rear partition parts.

49. Excavating device according to claim 26, wherein the at least one partition extends substantially transverse to the excavating direction.

50. Excavating device according to claim 26, wherein a direction of the flow of the mixture of soil and liquid through the opening is substantially transverse to the excavating direction.

* * * * *